United States Patent [19]

Ames et al.

[11] Patent Number: 4,968,361

[45] Date of Patent: Nov. 6, 1990

[54] METHOD OF DOMAIN REFINEMENT OF ORIENTED SILICON STEEL BY USING FLUX-PRINTING

[75] Inventors: S. Leslie Ames, Sarver; Charles D. Boyer, Natrona Heights, both of Pa.

[73] Assignee: Allegheny Ludlum Corporation, Pittsburgh, Pa.

[21] Appl. No.: 327,946

[22] Filed: Mar. 23, 1989

[51] Int. Cl.[5] ..... H01F 1/04

[52] U.S. Cl. ..... 148/110; 427/127

[58] Field of Search ..... 148/110–113; 427/127

[56] References Cited

U.S. PATENT DOCUMENTS 4,032,366 6/1977 Choby, Jr. ..... 148/113

4,655,854 4/1987 Nishiike et al. ..... 148/113

*Primary Examiner*—Melvyn J. Andrews

*Attorney, Agent, or Firm*—Patrick J. Viccaro

[57] ABSTRACT

A method is provided for domain refinement of final texture annealed grain-oriented silicon steel by removing portions of the base coating to substantially expose a line pattern of the underlying silicon steel by applying in the pattern an agent to the coated steel, heating the agent to activate it to cause substantial removal of the base coating in the line pattern and effecting heat resistant domain refinement and reduced core loss by allowing thermal and chemical treatment activity on the exposed steel.

20 Claims, 3 Drawing Sheets

30 x 100 x 40 x 100 x

METHOD OF DOMAIN REFINEMENT OF ORIENTED SILICON STEEL BY USING FLUX-PRINTING

BACKGROUND OF THE INVENTION

This invention relates to a method of improving core loss of grain oriented silicon steel by refining magnetic domain wall spacing. More particularly, the invention relates to a method of processing final texture annealed steel by applying a fluxing agent selectively to remove the oxide base coating before thermally and/or chemically treating to effect heat resistant domain refinement.

DESCRIPTION OF THE PRIOR ART

Grain-oriented silicon steel is conventionally used in electrical applications, such as power transformers, distribution transformers, generators, and the like. The steel's ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture, (110)[001] in terms of Miller's indices, results in improved magnetic properties, particularly permeability and core loss over nonoriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically of 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

The final texture annealed grain oriented silicon steel sheet has an insulation coating thereon resulting from an annealing separator coating, i.e. refractory oxide base coating, applied before the texture anneal to stop the laps of the coil from thermally welding or sticking together during the high temperature anneal and to promote formation of an oxide film on the steel surface. This film is desirable because it is an electrical insulator and can form part, or sometimes all, of the insulation needed when the steel is in operation in a transformer. Such an insulative oxide coating forming naturally during the texture anneal is known variously as forsterite, the base coating, or mill glass.

As used herein, "sheet" and "strip" are used interchangeably and mean the same unless otherwise specified.

It is also known through the efforts of many prior art workers, that cube-on-edge grain-oriented silicon steels generally fall into two basic categories: first, regular or conventional grain-oriented silicon steel, and second, high permeability grain-oriented silicon steel. Regular grain-oriented silicon steel is generally characterized by permeabilities of less than 1850 at 10 Oersteds with a core loss of greater than 0.400 watts per pound (WPP) at 1.5 Tesla at 60 Hertz for nominally 9-mil material. High permeability grain-oriented silicon steels are characterized by higher permeabilities which may be the result of compositional changes alone or together with process changes. For example, high permeability silicon steels may contain nitrides, sulfides, and/or borides which contribute to the precipitates and inclusions of the inhibition system which contributes to the properties of the final steel product. Furthermore, such high permeability silicon steels generally undergo heavier cold rolling reduction to final gauge than regular grain oriented steels for a final heavy cold reduction on the order of greater than 80% is made in order to facilitate the high permeability grain orientation. While such higher permeability materials are desirable, such materials tend to produce larger magnetic domains than conventional material. Larger domains are deleterious to core loss.

Larger domains are also favored by lighter gage. In other words, if one compares a 7 mil and a 9 mil material at identical permeability, the 7 mil sample will have larger domain size.

It is known that one of the ways that domain size and thereby core loss values of electrical steels may be reduced is if the steel is subjected to any of various practices designed to induce localized strains in the surface of the steel. Such practices may be generally referred to as "domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight lines, or scribes, generally spaced at regular intervals. The scribe lines are substantially transverse to the rolling direction and typically are applied to only one side of the steel. See U.S. Pat. Nos. 3,647,575 issued Mar. 7, 1972; 4,513,597 issued Apr. 30, 1985; and 4,680,062 issued July 14, 1987.

In fabricating electrical steels into transformers, the steel inevitably suffers some deterioration in core loss quality due to cutting, bending, and construction of cores during fabrication, all of which impart undesirable stresses in the material. During fabrication incident to the production of stacked core transformers and, more particularly, in the power transformers of the United States, the deterioration in core loss quality due to fabrication is not so severe that a stress relief anneal (SRA), typically about 1475° F. (801° C.), is essential to restore usable properties. For such end uses there is a need for a flat, domain-refined silicon steel which need not be subjected to stress relief annealing. In other words, the scribed steel used for this purpose does not have to possess domain refinement which is heat resistant.

However, during the fabrication incident to the production of most distribution transformers in the United States, the steel strip is cut and subjected to various bending and shaping operations which produce more working stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

It is known in the art of making electrical steel to attempt to produce heat resistant domain refinement. It has been suggested in prior patent art that contaminants or intruders may be effective in refining the magnetic domain wall spacing of grain-oriented silicon steel. U.S. Pat. No. 3,990,923-Takashina et al., dated Nov. 9, 1976, discloses that chemical treatment may be used on primary recrystallized silicon steel (i.e. before final texture annealing) to control or inhibit the growth of secondary recrystallization grains. British Patent Application No. 2,167,324A discloses a method of subdividing magnetic domains of grain-oriented silicon steels to survive an SRA. The method includes imparting a strain to the sheet, forming an intruder on the grain-oriented sheet, the intruder being of a different component or structure than the electrical sheet and doing so either prior to or after straining and thereafter annealing such as in a hydrogen reducing atmosphere to result in imparting the intruders into the steel body. Numerous metals and nonmetals are identified as suitable intruder materials.

Japanese Patent Document No. 61-133321A discloses removing surface coatings from final texture annealed magnetic steel sheet, forming permeable material coating on the sheet and heat treating to form material having components or structure different than those of the steel matrix at intervals which provide heat resistant domain refinement.

Japanese Patent Document No. 61-139-679A discloses a process of coating final texture annealed oriented magnetic steel sheet in the form of linear or spot shapes, at intervals with at least one compound selected from the group of phosphoric acid, phosphates, boric acid, borates, sulfates, nitrates, and silicates, and thereafter baking at 300–1200° C., and forming a penetrated body different from that of the steel to refine the magnetic domains.

Japanese Patent Document No. 61-284529A discloses a method of removing the surface coatings from final texture annealed magnetic steel sheets at intervals, coating one or more of zinc, zinc alloys, and zincated alloy at specific coating weights, coating with one or more of metals having a lower vapor pressure than zinc, forming impregnated bodies different from the steel in composition or in structure at intervals by heat treatment or insulating film coating treatment to refine the magnetic domains.

Japanese Patent Document No. 62-51202 discloses a process for improving the core loss of silicon steel by removing the forsterite film formed after final texture annealing, and adhering different metal, such as copper, nickel, antimony by heating.

Copending applications Ser. No. 205,711, filed June 10, 1988, and Ser. No. 206,152, filed June 10, 1988, by the Assignee of this invention discloses specific methods for refining the magnetic domain wall spacing of grain-oriented silicon steel using certain metal and nonmetal contaminants.

What is needed is a convenient and inexpensive method for removing the base coating in desired patterns in a method of refining the magnetic domain wall spacing of grain-oriented silicon steel The method should be compatible with conventional processing of regular and high permeability silicon steels, should make use of the thermally insulative coating on the sheet, and should be useful with numerous subsequent techniques to facilitate the domain refinement.

SUMMARY OF THE INVENTION

In accordance with the present invention, there is provided a method of refining the magnetic domain wall spacing of grain-oriented final texture annealed silicon steel having an insulation coating thereon. The method comprises removing portions of the oxide base coating to substantially expose a predetermined line pattern of the underlying steel. The removal includes applying, preferably by printing, a fluxing agent to the base coated steel in the line pattern, and then heating the agent on the steel to react and cause substantial removal of the base coating in the line pattern with little or no surface damage to the steel. Heat resistant domain refinement and reduced core loss is effected by allowing further chemical and/or thermal treatment activity on the substantially exposed steel areas.

DETAILED DESCRIPTION OF THE PREFERRED EMBODIMENTS

Broadly, the method of the present invention relates to a particular process of removing preselected portions of the oxide coating of silicon steel for thereafter effecting heat resistant domain refinement by allowing thermal and/or chemical treatment of the exposed steel, by any of several subsequent techniques. The width, spacing and pattern of lines of removed base coating may take the form of any of several conventional or known scribe patterns, preferably lines substantially transverse to the rolling direction. However, the pattern is uniquely removed by applying, preferably by printing, a fluxing agent to the oxide base coated steel in the desired pattern and heating the agent to react and cause substantial removal of the base coating in the pattern with little or no surface damage to the steel, and with no immediate improvement, and maybe even a deterioration, of magnetic properties. Heat resistant domain refinement and reduced core loss are thereafter effected by allowing thermal and/or chemical treatment on the pattern of exposed steel.

The invention is particularly useful in conventional processing lines wherein steel strip moves at speeds of up to 500 feet per minute. The invention should also be useful at higher speeds of up to 2000 feet per minute such as used in high speed printing techniques. It appears that the constraint on speed primarily may depend on the time for the "ink" to dry. High speed "firing" devices such as induction or radiant heaters which heat surface layers should be useful.

In general terms in accordance with the teachings of the present invention, the method includes applying, preferably by printing, a flux agent to the base coated steel in a desired pattern. It has been found that conventional printing techniques and equipment may be suitable if modified so as to apply a suitable agent to the silicon steel at desired speeds, thicknesses and patterns.

Various printing techniques may be suitable for the present invention including stencil, offset, intagliotype, planographic, lithographic, and flexographic. Two methods and equipment of continuous printing are shown schematically in FIGS. 1 and 2.

Figure 1:
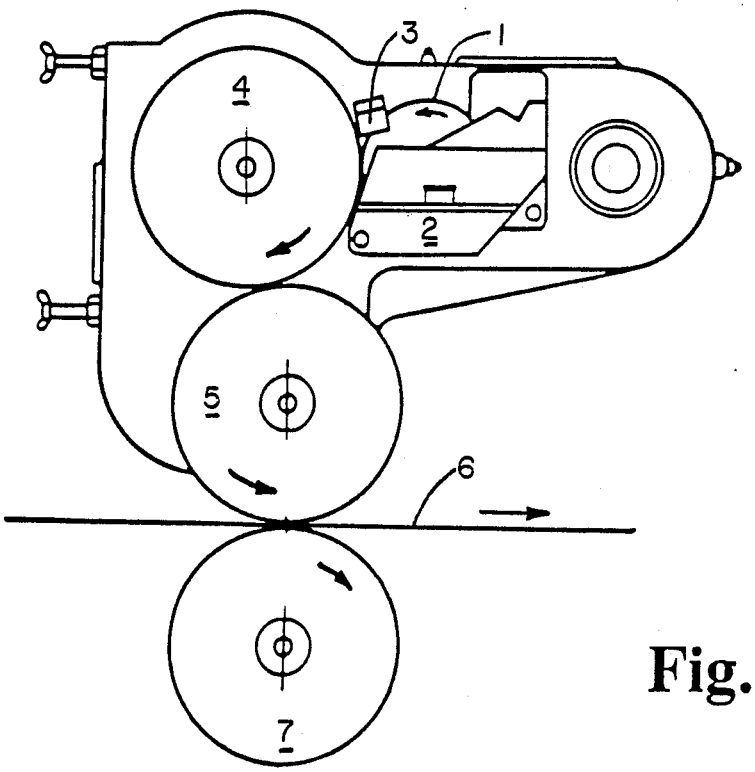
FIG. 1 is a schematic of an offset printing press.

FIG. 1 is a schematic of a widely used conventional offset printing press in which a cluster of three rolls are used in applying the ink. The ink roll 1 rotates about its axis, dips into ink well 2, collects a layer of ink which is metered or wiped to a uniform layer as it passes against metering bar 3. The inked roll 1 then presses against the rotating second roll, i.e. print roll 4 on which the print, pattern, or design (hereinafter print-message) is located. The inked print roll 4 then presses against rotating third roll 5, the so-called blanket roll, on to which the print-message is transferred from roll 4. Finally, the rotating blanket roll presses against the substrate strip 6 and the print message is transferred to the strip 6 as it moves continuously between roll 5 and backup roll 7. The back-up roll 7 may or may not be necessary with this invention although it is conventionally used in the paper industry.

Figure 2:
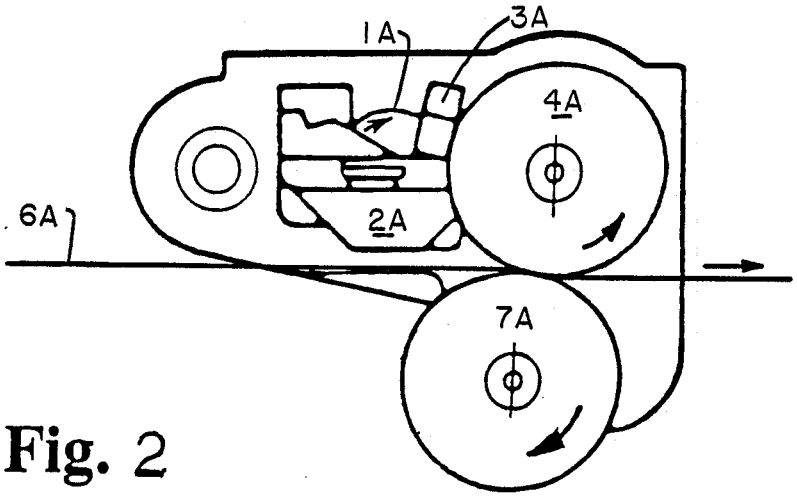
FIG. 2 is a schematic of a flexographic printing press.

In FIG. 2, a schematic of known flexographic printing is illustrated. The process is a modification of conventional three-roll offset printing, with the important difference being that new materials which are both tough and flexible are used for the print roll 4A. Such new materials may be special rubbers or photo-polymers. They are sufficiently rugged for making direct contact with and printing on the moving substrate rather than via a blanket roll. Although the ink delivery roll 1 for offset printing of FIG. 1 is conventionally solid and smooth, the flexographic printer of FIG. 2 has a honeycombed surface of ink roll 1A against which the flexible print roll 4A presses, literally sucking the ink out of the honeycomb cells. As with offset printing, the back-up roll 7A included in FIG. 2 is conventional but may not be essential for strong substrates such as metal.

For non-continuous printing, well-known stencilling methods can be used (not shown). In such cases, the substrate to be printed is covered with a mask which has the print-message precut through as slots and openings. Ink is rolled or sprayed onto the stencil-substrate assembly and contacts the substrate in the slotted areas. Removal of the stencil completes the printing operation and reveals the printed substrate.

The consistency and viscosity of the ink used in printing techniques may vary and is dependent on the technique used. For example, the ink used for offset printing has to be of similar viscosity to thick syrup (e.g. 10,000 centipoise). Flexographic printing is much more tolerant of ink viscosity and is capable of printing inks from thin liquid to paste consistencies. For stencilling, the ink has to have a thick consistency for roller application, and must have a thin consistency for spray application.

Grain-oriented silicon steel used in the herein disclosed tests was produced by casting, hot rolling, normalizing, cold rolling to intermediate gauge, annealing and cold rolling to final gauge, decarburizing, and final texture annealing to achieve the desired secondary recrystallization of cube-on-edge orientation Typical melts of nominal initial composition of conventional (Steel 1) and high permeability (Steel 2) grain-oriented silicon steels were:

| | ELEMENTS | | | | | | | |
|---|---|---|---|---|---|---|---|---|
| | C | N | Mn | S | Si | Cu | B | Fe |
| Steel 1 | 030 | <50 ppm | .07 | .022 | 3.15 | .22 | — | Bal. |
| Steel 2 | 030 | <50 ppm | .038 | .017 | 3.15 | .30 | 10 ppm | Bal. |

After final texture annealing, the C, N, and S were reduced to trace levels of less than about 0.001%. The strip was cut into numerous pieces to produce samples of sizes sufficient for processing in accordance with the present invention Final sample size for magnetic testing was that of the well known Epstein strip of 30 cm. long×3 cm. wide. Epstein strips were tested both as stacked packs and as single strips as indicated.

The method of the present invention recognizes that the layer of forsterite required to be broken through or substantially removed is very thin, typically 5 microns (.005 mm). It has been found that the layer can be penetrated easily and quickly, using a small amount of a fluxing agent. The flux agent is applied to the forsterite surface in the precise pattern of lines needed for a subsequent chemical and/or thermal treatment to develop heat-proof domain refinement. As used herein, the pattern of exposed or substantially exposed pattern of lines through the forsterite to the silicon steel substrate is referred to as "metal stripes".

The flux agent may be applied or printed in various thicknesses to the base coating depending on flux agent consistency, concentration, heating time and temperatures. Preferably, the thickness may range from 0.005 to 0.127 mm (0.02 to 0.5 mils).

A suitable flux agent should have a consistency and viscosity compatible with the method of application or printing to the silicon steel. The agent must be capable of dissolving the oxide layer, i.e. forsterite, formed on the final texture annealed steel. Furthermore, the agent should be capable of being self-activated or activated in a manner consistent with manufacturing processes for grain oriented silicon steel. A relatively low temperature heating step must be used.

A fluxing agent for dissolving the oxide layer formed on the steel as used in brazing can include: Boric Acid, Borates, Chlorides, Fluorides, Fluoroborates, and Phosphoric Acid. While only the salt radical is listed above, the metal radical is frequently from the group of sodium, potassium and lithium. It was found that one of many commercial fluxes employed commonly for brazing and soldering steels may be suitable. There are several generic fluxes available from this group which are effective at firing temperatures in air between approximately 1050° F. and 1600° F. (566 and 871° C.), and are available as powder, paste, or liquid. There are also available proprietary brand fluxes, such as sold under the tradenames "Stay-Silv", "Brazo-Flux" and "Welco-Flux".

As will be more evident hereinafter, after the flux-printing step, the applied flux agent must be subject to heat to effect the firing or activation in which connection the invention contemplates the employment of a heating zone immediately following the printing step.

The application of the "heating" or "firing" step can be performed in a furnace at a temperature of greater than 200° F. (93° C.) and preferably 900° F.–1650° F. (482–899° C.) and more preferably 1050° F.–1600° F. (566 to 871° C.). Preferably, the heating is a rapid heating with no substantial hold time. The fluxing action is intensified when firing is in air. A reducing atmosphere, such as hydrogen or an inert atmosphere, such as argon, completely inhibits the reaction and cannot be used. The method of the invention requires a substantially oxidizing atmosphere, such as an air atmosphere.

In the development of the invention, samples of several representative proprietary brands of brazing and welding fluxes were applied in small quantities to final texture annealed grain oriented silicon steel coupons having a normal continuous forsterite layer. The coupons were then heated in air for about a minute. After cooling, the degree of forsterite removal was determined by dipping in a copper sulfate solution which electrolessly plates copper on bare iron but not on the forsterite. The procedure allowed an approximate rating of the effectiveness of a flux in removal of and breaking through the forsterite. All of the fluxes tried appeared satisfactory in this respect.

EXAMPLE 1

After the above testing, three brand fluxes were selected for stencil-print trials. "Aqualloy-Flux" and "Nokorode" fluxes were in a petroleum base vehicle which was suitable for the stencilling operation to apply the lines of flux agent to the steel. In contrast, "Handy-Flux" material was in a water base paste which was found to be much less suitable for stencilling. This problem was solved by mixing the flux with a neutral ointment base to a consistency approximating that of the petroleum base paste. This third flux in paste form then stencilled quite well.

The stencil was a thin plastic sheet of a size suitable for covering an Epstein strip and had 0.5 mm wide slits cut out forming parallel openings at 5 mm intervals. For stencilling, the flux paste was first applied as a thin layer to a dummy metal strip. The stencil was then interposed between the pasted dummy strip and the test strip of silicon steel. The sandwich so formed was subjected to gentle pressure by a roller sufficient to apply the flux on the test strip in line pattern generally transverse to the rolling direction of the test strip. The stencil was then peeled from the sandwich.

Twenty six Epstein strips of 9 mil high permeability grain-oriented Steel 2 were stencil-printed using the three selected flux pastes described above. The firing temperature, in an air muffle furnace, was 900–1500° F. (482–816° C.) for one minute and was found to be not critical. All flux samples performed well regardless of firing temperature in this range; a temperature of 1300° F. (704° C.) was judged marginally the best.

Figure 3A:
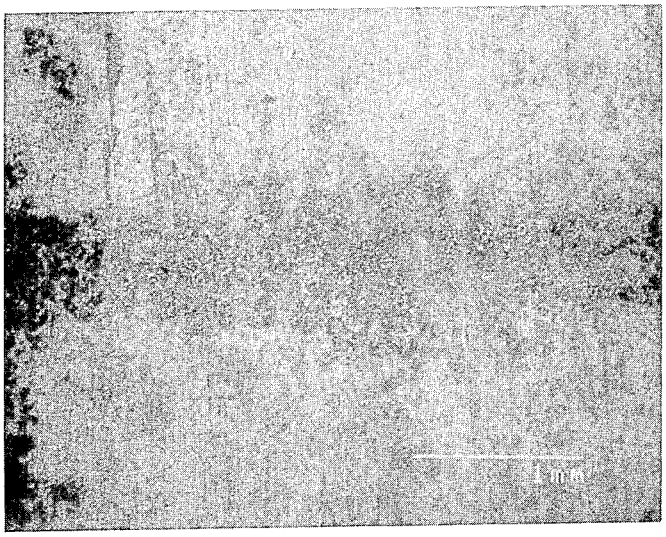
FIGS. 3A and 3B are 30X and 100X photomicrographs of the surface of a test specimen, after printing and heating, showing craters through the oxide base coating.
Figure 3B:
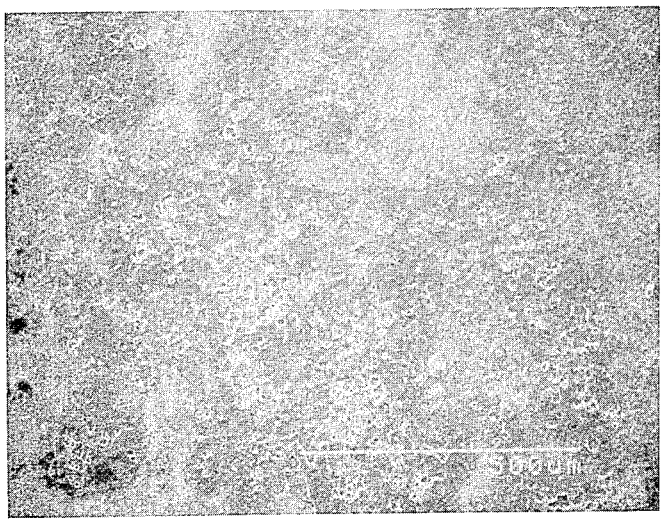

FIG. 3A and 3B are representative photomicrographs, 30X and 100X respectively, of the surface of a 7 mil test specimen after printing and heating to show craters or breaks through the base glass. Using the previously described copper sulfate test as indicative of breakthrough of the forsterite, all samples showed adequate breakthrough All samples were then subjected to subsequent processing to effect domain refinement by attacking the base metal stripe with phosphorus This heat resistant domain refining process of phosphorus-striping was done in accordance with the teachings of a copending application, Ser. No. 206,152, filed June 10, 1988, by the Assignee of this invention. There is disclosed a method for refining the domain wall spacing of final texture annealed grain-oriented silicon steel by applying a phosphorus contaminate to a pattern of exposed steel being free of thermal and plastic stresses. The phosphorus-striping process includes phosphorus vapor being generated at or near the strip surface, for example by hydrogen reduction of a phosphate coating. The phosphorus migrates to any exposed iron (such as the metal stripes), attacks the iron, and forms wedge-shaped phosphide particles. For this example, phosphorus was applied as described in the application by roller coating of a "P" coating having the following solution:

Phosphoric Acid: 118 gm/l
Magnesium Oxide: 18 gm/l
Ammonium Hydroxide (58%): 20 gm/l
Chromium Dioxide: 34 gm/l
Dupanol (2%): 1 gm/l
Water: Balance The coated metal strip samples were air dried for 1 minute at 800° F. Total coating thickness (both sides) was about 0.1 mil.

The sample strips were then heated in hydrogen for five hours at 1650° F. (899° C.) to chemically reduce the thin phosphate coating by releasing phosphorus vapor to attack the exposed metal stripes. Magnetic properties were determined following this stage of processing in comparison with the initial properties. Average properties for each of the three groups were as follows:

| Brand of Flux Paste | Number of Samples | As-scrubbed Permeability @ 10 Oe | As-scrubbed Core Loss (wpp) 1.5 T | As-scrubbed Core Loss (wpp) 1.7 T | Flux-printed, fired and Phosphorus-Striped Permeability @ 10 Oe | Flux-printed, fired and Phosphorus-Striped Core Loss (wpp)* 1.5 T | Flux-printed, fired and Phosphorus-Striped Core Loss (wpp)* 1.7 T |
|---|---|---|---|---|---|---|---|
| Handy-Flux | 10 | 1922 | .470 | .658 | 1915 | .430 (−9%) | .595 (−10%) |
| Aqualloy Flux | 10 | 1922 | .487 | .684 | 1903 | .390 (−20%) | .544 (−20%) |
| Nokorode | 6 | 1905 | .475 | .684 | 1896 | .398 (−16%) | .570 (−17%) |

(*Numbers in parentheses = % change versus original)

Figure 4A:
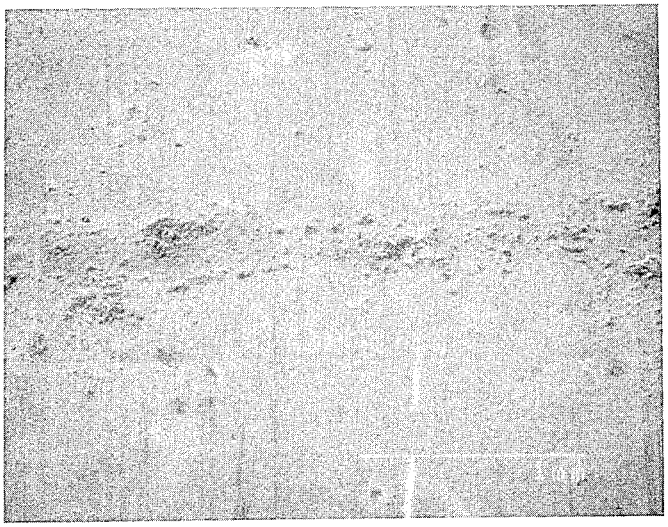
FIGS. 4A and 4B are 40X and 100X photomicrographs of the surface of a test specimen after printing, heating and phosphorus striping showing iron phosphide particles in substantially exposed metal stripes.
Figure 4B:
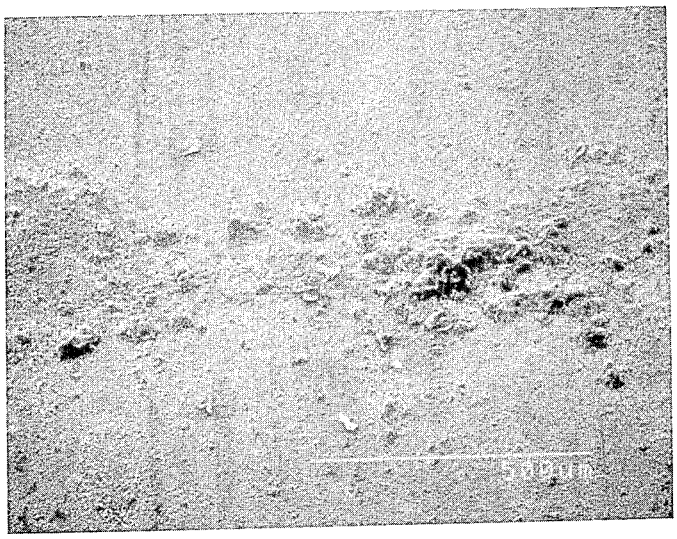

Average improvement in core loss at 1.5 Tesla for all twenty-six samples was 15%. This example demonstrates the advantages of the present-claimed invention. First, the method provides an effective means for removing portions of the base coating to substantially expose a predetermined line pattern of the underlying steel. Second, a subsequent treatment activity on the substantially exposed steel can result in domain refinement and reduced core loss. Particularly, the flux printing and phosphorus striping method treatment provides excellent heat resistant domain refinement, reduced core loss and retained high magnetic permeability. FIGS. 4A and 4B are representative photomicrographs 40X and 100X respectively, of the surface of a 7 mil test specimen after printing, heating, and phosphorus striping showing iron phosphide particles in the metal stripes.

EXAMPLE 2

A second series of experiments were conducted on two eight-strip Epstein packs of (a) 7 mil conventional grain oriented steel of Steel 1 and (b) 8 mil high permeability grain oriented steel of Steel 2 in a manner similar to Example 1. Two fluxes were used. One was based on the commercial Aqualloy-Flux agent used in Example 1 having the following composition:

#51 Flux
Phosphoric acid (85%): 41% wt.
Petroleum jelly: 35%
Poly-ethylene glycol: 24%

The #51 flux was used for the 8 mil samples. The 7 mil samples had a somewhat thicker base glass i.e. forsterite, and the following more aggressive modified flux agent was used, designed empirically from a series of test flux firings.

Flux No. SSA
Phosphoric acid (85%): 27% wt.
Potassium fluoborate: 24%
Petroleum jelly: 23%
Poly-ethylene glycol: 16%
"Aquaphor" brand ointment base: 10%

Stencilling followed the practice of Example 1 and the flux-printed samples were then fired at approximately 1300° (704° C.) F. As for Example 1, phosphorus striping was by P coating in conjunction with a 5 hour hydrogen diffusion anneal at approximately 1650 F. (899° C.).

Magnetic properties again showed significant improvement as shown below.

| Alloy | As-scrubbed | | | Flux-printed and fired | | | Flux-printed; fired; phosphorus-striped | | |
|---|---|---|---|---|---|---|---|---|---|
| | Permeability | Core Loss (wpp) | | Permeability | Core Loss (wpp) | | Permeability | Core Loss* (wpp) | |
| | @ 10 Oe | 1.5 T | 1.7 T | @ 10 Oe | 1.5 T | 1.7 T | @ 10 Oe | 1.5 T | 1.7 T |
| Steel 1 | | | | | | | | | |
| | 1849 | .416 | .641 | 1847 | .408 | .651 | 1848 | .392 (−6%) | .616 (−4%) |
| Steel 2 | | | | | | | | | |
| | 1936 | .432 | .529 | 1927 | .458 | .650 | 1920 | .385 (−11%) | .532 (−10%) |

(*Numbers in parentheses = % change versus original)

After heating the samples to 1650° F., the magnetic improvements were found to be heat resistant. Note that the somewhat deteriorated properties in the "flux-printed and fired" condition are consistent with the intermediate and preparatory step for a subsequent completion of the domain refining process, for example the phosphorus-striping process used in both Examples 1 and 2.

EXAMPLE 2

Samples of high permeability oriented steel of Steel 2 were flux-printed continuously on a Matthews Model 6029 printing press which is capable of printing on 3 inch wide strip material. The press was operated in a flexographic mode (see FIG. 2), i.e. the print roll printed directly on the Epstein strips rather than through the action of a blanket roll. The ink base used was Matthews commercial #M165 black ink marketed for conventional printing. It is of syrupy consistency with a viscosity of about 10,000 centipoise. To the ink base was added 20% phosphoric acid, by weight. Printing of 5 mm spaced parallel lines of 0.25 mm width substantially transverse to the rolling direction of the steel was done at 50 ft/min. line speed. Ink thickness applied to the forsterite layer of steel was about .01 mm (0.065 mils). The samples were allowed to dry and then heated in air to 1300° F. (704° C.) before being phosphorus striped as in Examples 1 and 2. Average results were as follows for eight samples.

| Initial As-Scrubbed | | | Flux printed; fired; phosphorus striped | | |
|---|---|---|---|---|---|
| Permeability | Core Loss (wpp) | | Permeability | Core Loss (wpp)* | |
| @ 10 Oe | 1.5 T | 1.7 T | @ 10 Oe | 1.5 T | 1.7 T |
| 1943 | .396 | .539 | 1926 | .380 (−4%) | .524 (−3% |

*Numbers in parentheses = % change versus original

The magnetic core loss properties showed a mild improvement using the diluted fluxing agent-ink composition used for the continuous printing.

EXAMPLE 4

This series of tests on Steel 2 was similar to that in Example 3 except that a much more concentrated fluxing ink was used. The ink was devised by mixing phosphoric acid (85% strength) with poly-ethylene glycol as a thickening agent until viscosity similar to the #M165 commercial black ink used in Example 3 was attained. Specifically, the fluxing ink contained 75% phosphoric acid and 25% poly-ethylene glycol. This ink printed well and yielded lines of about .025 mm (0.1 mil) thickness applied to the forsterite. Line spacing was 5 mm and line width 0.25 mm. Processing, except for the different ink, was identical to Example 3. Results of tests on eight Epstein strips of 9 mil high-permeability oriented steel of Steel 2 are shown below.

| Sample No. | As-scrubbed Permeability @ 10 Oe | As-scrubbed Core Loss (wpp) 1.5 T | As-scrubbed Core Loss (wpp) 1.7 T | Flux-printed; fired; and phosphorus-striped Permeability @ 10 Oe | Flux-printed; fired; and phosphorus-striped Core Loss (wpp) 1.5 T | Flux-printed; fired; and phosphorus-striped Core Loss (wpp) 1.7 T |
|---|---|---|---|---|---|---|
| MT20 | 1942 | .357 | .476 | 1920 | .351 | .492 |
| 21 | 1890 | .432 | .613 | 1876 | .396 | .585 |
| 22 | 1937 | .490 | .659 | 1918 | .367 | .554 |
| 23 | 1932 | .401 | .575 | 1920 | .387 | .547 |
| 24 | 1951 | .453 | .620 | 1937 | .359 | .518 |
| 25 | 1932 | .491 | .657 | 1928 | .421 | .566 |
| 26 | 1906 | .557 | .763 | 1899 | .448 | .677 |
| 27 | 1951 | .366 | .513 | 1944 | .360 | .493 |
| Average | 1930 | .443 | .610 | 1918 | .386 (−14%) | .554 (−9%)* |
| Tested As Epstein Pack | 1940 | .443 | .621 | 1924 | .389 (−12%) | .558 (−10%)* |

(*Numbers in parentheses = % change versus original)

The data of Example 4 clearly establishes the heat resistant domain refinement possible following the step of using the flux agent to remove portions of the forsterite in a predetermined pattern. The magnetic improvement in core loss was excellent and permanent after SRA for 1 hour at 1475° F. (801° C.) as shown below:

| | Permeability @ 10 Oe | Core Loss (wpp) 1.5 T | Core Loss (wpp) 1.7 T |
|---|---|---|---|
| MT20 | 1917 | .358 | .484 |
| 21 | 1873 | .407 | .584 |
| 22 | 1916 | .370 | .536 |
| 23 | 1920 | .358 | .506 |
| 24 | 1934 | .377 | .555 |
| 25 | 1926 | .429 | .585 |
| 26 | 1893 | .485 | .680 |
| 27 | 1938 | .367 | .507 |
| Average | 1915 | .394 | .555 |
| Tested As Epstein Pack | 1926 | .391 | .557 |

The permeability at 200 Gauss for the Epstein pack was 14400 after the stress relief anneal which compares well with the value of 14900 for the domain refined material before the SRA. This is another indication of the excellent core loss properties.

As was an object of the present invention, an intermediate method step has been provided for conveniently and inexpensively removing the base coating of grain oriented silicon steel in desired patterns for refining the magnetic domain wall spacing. The method of removing may be in batch mode or continuously, both of which can be incorporated into continuous mill processing of conventional and high permeability grain oriented silicon steel.

Firing of the agent to "burn" the stripes through the forsterite would be a simple low cost process step readily amenable to a continuous strand operation. It appears necessary only to heat the strip to temperature in air atmosphere with no hold time required.

The selective removal of base coating is followed by a subsequent thermal and/or chemical treatment to effect the domain refinement which is heat resistant. Although the phosphorus striping process was demonstrated to effect domain refinement, other processes or metal or nonmetals may be used with varying degrees of success to effect domain refinement once the pattern of bare metal stripes has been provided in accordance with this invention.

Although preferred and alternative embodiments have been described, it will be apparent to one skilled in the art that changes can be made therein without departing from the scope of the invention.

What is claimed is:

1. A method of refining the magnetic domain wall spacing of grain-oriented final texture annealed silicon steel sheet having an insulation base coating thereon, the method comprising:

(a) removing portions of the base coating to substantially expose a desired line pattern of the underlying steel by applying to the base coated steel an agent in the line pattern, and heating the agent on the base coated steel to react and cause substantial removal of the base coating in the line pattern with no more than minimal surface damage to the steel; and (b) effecting domain refinement and reduced core loss by allowing other thermal and chemical treatment activity on the substantially exposed steel.

2. The method of claim 1 wherein the pattern comprises generally parallel lines extending substantially transverse to the rolling direction of the steel.

3. The method of claim 1 wherein applying an agent includes printing the agent onto the base coated steel

4. The method of claim 3 wherein the agent is printed in thicknesses ranging from 0.02 to 0.5 mils.

5. The method of claim 3 wherein the step of printing is selected from the group consisting of stencil, offset, intagliotype, planographic, lithographic, and flexographic

6. The method of claim 1 wherein the agent is a flux.

7. The method of claim 6 wherein the flux agent includes at last one salt selected from the group consisting of boric acid, borates, chlorides, fluorides, fluoroborates and phosphoric acid.

8. The method of claim 6 wherein the flux agent is of the type suitable for soldering or brazing.

9. The method of claim 6 wherein the flux agent comprises 27 to 41%, by weight, phosphoric acid.

10. The method of claim 1 wherein the agent is capable of dissolving oxides of the type found in the base coating.

11. The method of claim 1 wherein the agent is in a petroleum base vehicle.

12. The method of claim 1 wherein the agent has the consistency of a petroleum paste when applied.

13. The method of claim 1 wherein the heating step includes heating the agent to a temperature range of 900 to 1650° F.

14. The method of claim 13 further including rapid heating to temperature without any substantial hold time.

15. The method of claim 1 wherein the heating step is done in a substantially oxidizing atmosphere.

16. The method of claim 1 wherein the heating step is a rapid heating using induction or radiant heating.

17. The method of claim 1 further including moving the steel continuously at speeds of up to 2000 feet per minute.

18. The method of claim 1 wherein the step of effecting domain refinement results in heat resistant domain refinement 19. The methods of claim 18 wherein effecting heat resistant domain refinement is performed by allowing phosphorus attack of the substantially exposed underlying steel.

20. A method of refining the magnetic domain wall spacing of grain-oriented final texture annealed silicon steel sheet having an insulation base coating thereon, the method comprising:

(a) removing portions of the base coating to substantially expose a desired line pattern of the underlying steel by printing onto the base coated steel the flux agent in a line pattern at a thickness of 0.02 mil or more, and rapidly heating the agent on the base coated steel to a temperature range of 900 to 1650° F. without any substantial hold time, in a substantially oxidizing atmosphere to activate the agent to cause substantial removal of the base coating in the line pattern with no more than minimal surface damage to the steel;

(b) while moving the steel continuously at speed of up to 2000 feet per minute; and (c) effecting heat resistant domain refinement and reduced core loss by allowing other thermal and chemical treatment activity on the substantially exposed steel.

* * * * *